US006536918B1

(12) United States Patent
Böröczki et al.

(10) Patent No.: US 6,536,918 B1
(45) Date of Patent: Mar. 25, 2003

(54) LIGHTING SYSTEM FOR GENERATING PRE-DETERMINED BEAM-PATTERN

(75) Inventors: Ágoston Böröczki, Budapest (HU); István Csányi, Dunakeszi (HU); Sándor Holló , Dunakeszi (HU); Michael R. Armbruster, Mentor, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/644,363

(22) Filed: Aug. 23, 2000

(51) Int. Cl.[7] ..... H01J 1/00; H01J 9/20
(52) U.S. Cl. ..... 362/263; 313/573
(58) Field of Search ..... 362/263, 264, 362/265; 313/570, 573, 637, 634, 493

(56) References Cited

U.S. PATENT DOCUMENTS

| | | | | | |
|---|---|---|---|---|---|
| 4,513,357 | A | * | 4/1985 | Nieda et al. | 362/544 |
| 4,622,493 | A | * | 11/1986 | Yasuda | 313/642 |
| 4,935,660 | A | * | 6/1990 | Heider | 313/25 |
| 5,118,990 | A | * | 6/1992 | Makita | 315/77 |
| 5,138,229 | A | * | 8/1992 | Honda | 313/628 |
| 5,162,693 | A | * | 11/1992 | Van Der Leeuw | 313/27 |
| 5,188,444 | A | * | 2/1993 | Makita et al. | 362/519 |
| 5,424,609 | A | * | 6/1995 | Geven et al. | 313/331 |
| 5,597,232 | A | | 1/1997 | Ohashi et al. | |
| 5,676,579 | A | | 10/1997 | Parham et al. | |
| 5,744,901 | A | | 4/1998 | Friederichs et al. | |
| 5,828,185 | A | | 10/1998 | Fellows et al. | |
| 5,895,113 | A | * | 4/1999 | Ozaki et al. | 362/546 |
| 5,932,969 | A | * | 8/1999 | Ikeuchi et al. | 313/623 |
| 5,945,776 | A | * | 8/1999 | Koster | 313/113 |
| 6,060,820 | A | * | 5/2000 | Noll | 313/113 |
| 6,111,359 | A | * | 8/2000 | Work et al. | 313/25 |
| 6,191,538 | B1 | * | 2/2001 | Hirschmann | 315/240 |
| 6,194,834 | B1 | * | 2/2001 | Seiler | 315/82 |
| 6,294,870 | B1 | | 9/2001 | Kawashima et al. | |

FOREIGN PATENT DOCUMENTS

| | | |
|---|---|---|
| EP | 0 533 325 A1 | 3/1993 |
| EP | 0 534 606 A1 | 3/1993 |
| EP | 0 883 160 A1 | 12/1998 |
| EP | 1 107 285 A2 | 6/2002 |
| JP | 2000156201 | 6/2000 |

* cited by examiner

*Primary Examiner*—Sandra O'Shea
*Assistant Examiner*—Hargobind S. Sawhney
(74) *Attorney, Agent, or Firm*—Fay, Sharpe, Fagan, Minnich & McKee, LLP

(57) ABSTRACT

A lighting system for generating pre-determined beam-pattern comprises a reflector body for reflecting the light forwardly thereof, an optical means for receiving and transmitting said reflected light, a discharge lamp and a lamp base. The discharge lamp is positioned between the reflector body and the optical means. The discharge lamp comprises a sealed discharge vessel made of ceramic light-transmitting material and contains an ionizable fill. The discharge lamp has at least one leg, a pair of spaced-apart electrodes within the discharge vessel between which an electric discharge is developed when the lamp is operated. The lamp base provides for supporting and positioning the discharge lamp, and includes contact elements for connecting the discharge lamp to an operating circuit.

20 Claims, 3 Drawing Sheets

LIGHTING SYSTEM FOR GENERATING PRE-DETERMINED BEAM-PATTERN

FIELD OF THE INVENTION

This invention relates to a lighting system, and, more particularly, to a system in which the light source has a suitable structure for generating a light which can be transformed by other components of the system so that a predetermined beam-pattern is provided.

BACKGROUND OF THE INVENTION

Lighting systems generating pre-determined beam-patterns for the illumination of a target requiring a well-defined beam-pattern are widely used in practice for example as automotive headlamps, aircraft headlamps, locomotive headlamps, water craft headlamps or air traffic taxi lights. The light has a pre-determined beam-pattern when, for example and not exclusively, a cut off may be designed into the pattern of the beam. Most often, halogen incandescent lamps or recently high intensity discharge lamps with fused silica arc chambers are used in these lighting systems in order to meet the specific requirements set up for the light source component. U.S. Pat. No. 5,597,232 discloses a reflector lamp in which the light source is a metal halide lamp. The reflector lamp provides pre-determined beam-pattern and the arc chamber of the metal halide lamp, as it is known to an expert skilled in the art, is made of fused silica.

The metal halide lamp in lighting systems of this kind are highly overloaded in order to accomplish the required optical performance. Due to the overload, the useful life of the light source component is shorter. This life is also influenced by the severe ambient temperature conditions which originate from the required compactness of these lighting systems. The metal halide light sources suffer from short life at high operating temperatures owing to the devitrification of the arc chamber material and to the cracking of the seal area. This leads to giving up the useful life of the light source component for its performance which results in an inadequate life or in the need of relatively frequent replacement of the light source.

Ceramic metal halide lamps are a new generation of high performance, high intensity discharge light sources offering superior characteristics compared to the light sources mentioned above. The ceramic metal halide lamps have only been used for general lighting applications so far. In the past, designers might be prejudiced against the use of ceramic metal halide lamps in lighting systems for generating predetermined beam-pattern owing probably to the relatively great size and diffuse light of these lamps. Although, a reflector lamp using a ceramic metal halide light source is described by U.S. Pat. 5,744,901. In the reflector lamp disclosed, the ceramic discharge vessel of the lamp is secured in the reflector body made of glass. This reflector lamp however is not capable of providing a pre-determined beam-pattern of light. Its pattern of beam cannot be designed to have for example a cut off which is a must e.g. for an automotive low beam headlamp.

It is therefore seen to be desirable to provide a lighting system for generating pre-determined beam-pattern which has a longer useful life and requires less maintenance cost.

BRIEF SUMMARY OF THE INVENTION

In an exemplary embodiment of a first aspect of the present invention, a lighting system for generating pre-determined beam-pattern comprises a reflector body for reflecting the light forwardly thereof, an optical means for receiving and transmitting said reflected light, a discharge lamp and a lamp base. The discharge lamp is positioned between the reflector body and the optical means. The discharge lamp comprises a sealed discharge vessel made of ceramic light-transmitting material and contains an ionizable fill. The discharge lamp has at least one leg, a pair of spaced-apart electrodes within the discharge vessel between which an electric discharge is developed when the lamp is operated. The lamp base provides for supporting and positioning the discharge lamp, and includes contact elements for connecting the discharge lamp to an operating circuit.

In an exemplary embodiment of a second aspect of the present invention, the lighting system for generating predetermined beam-pattern also comprises an operating circuit for igniting the discharge lamp and providing for steady state operation thereof. The sealed discharge vessel has means for making the discharge lamp at least approximately a point-like light source. The lamp base includes contact elements for connecting the operating circuit to a power supply.

This system has a number of advantages over the prior art represented by U.S. Pat. No. 5,597,232. One advantage is that the useful life of the system is extended. Another advantage is that it has an increased reliability and requires less maintenance cost. A further advantage is that the light projected by this system has a better color consistency, color stability and color separation properties. The efficiency and lumen maintenance of the system is also increased.

By properly matching the design and the dimensions of the ceramic metal halide light source and the components of the optical system responsible for the generation of the required pre-determined beam-pattern, a significant improvement is accomplished in the performance of such lighting systems. From light source side, several modifications are made on the current ceramic metal halide light source designs that make ceramic metal halide technology more suitable for its application to systems generating predetermined beam-pattern.

DETAILED DESCRIPTION OF THE INVENTION

Figure 1:
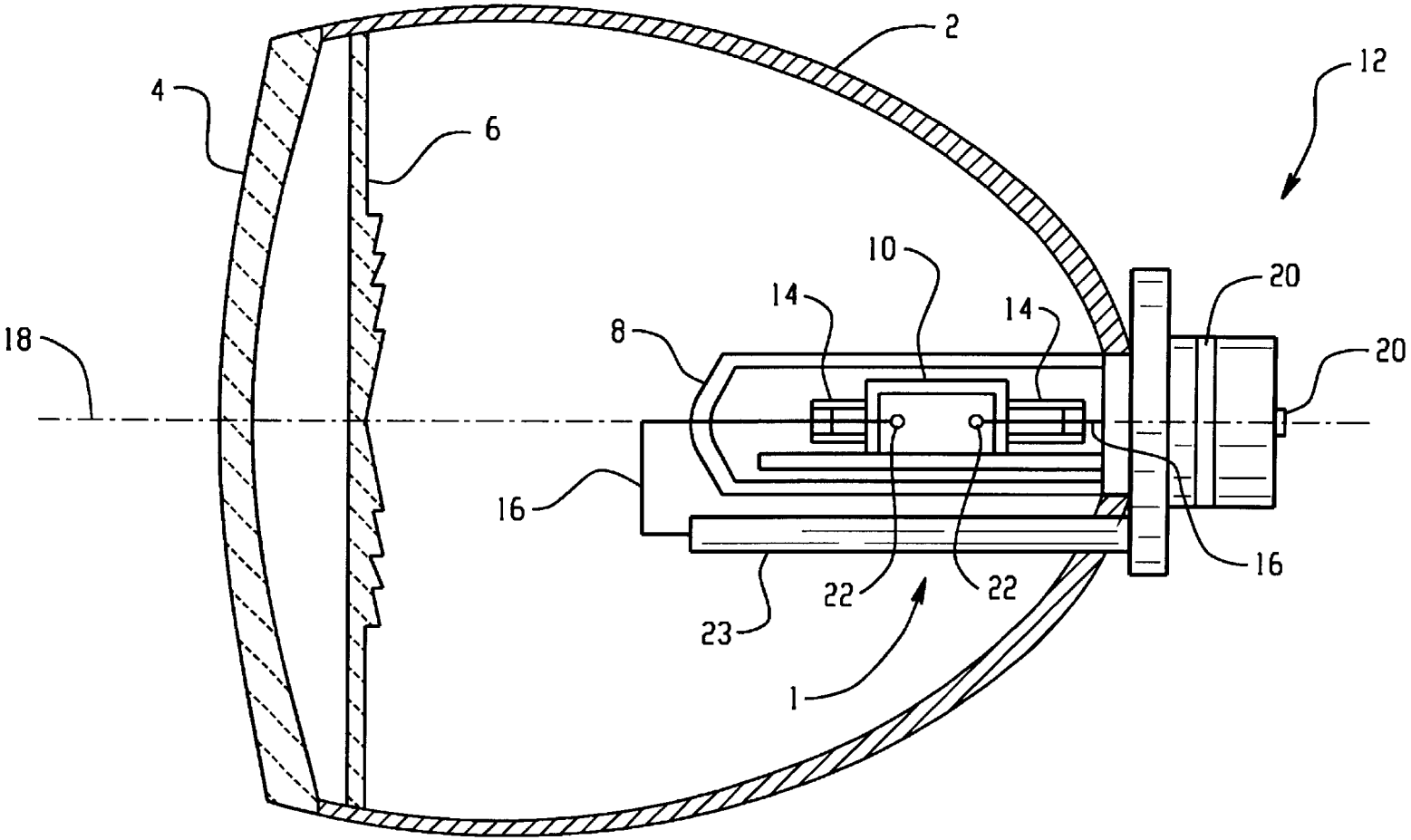
FIG. 1 shows an axial section of a reflector, in which the lighting system of the present invention is embodied, having a ceramic metal halide lamp with tubular discharge vessel.

In FIG. 1, a reflector comprises a reflector body 2 having an optical axis 18 along which light is reflected from the reflector body 2 forwardly thereof. An optical means, which is a lens 6 in this embodiment, is secured in place at a front end of the reflector body 2 for receiving and transmitting the reflected light. A discharge lamp 1 having an optical axis is disposed substantially parallel to the optical axis 18 of the reflector body 2 and mounted in a position between the reflector body 2 and the lens 6 for generating the light. The. discharge lamp 1 comprises a sealed discharge vessel 10 of ceramic light-transmitting material and contains an ionizable fill and has two legs 14. This ceramic light-transmitting material may be for example monocrystalline metal oxide, e.g. sapphire, polycristalline metal oxide, e.g. translucent gastight aluminum oxide (DGA), yttrium-aluminum garnet (YAG) or yttrium-oxide (YOX), or polycristalline non-oxidic material such as aluminum nitride (AlN). These materials may have polycrystalline or single-crystal structure. The ionizable fill contains an inert gas, a mixture of metal halides, e.g. sodium-iodide and scandium-iodide, and a material of high electron collision cross section, e.g. mercury. For environment protection, it is desirable to replace the mercury by other materials of high electron collision cross section, e.g. zinc, zinc halide, or to eliminate it from the fill completely. A pair of spaced-apart electrodes 22 is provided within the discharge vessel 10 between which an electric discharge is developed when the lamp is operated. Lead-in-wires 16 supply current to the electrodes 22 in the discharge vessel 10. An outer jacket 8 made of vitreous material surrounds the discharge vessel 10. A lamp base 12 for supporting and positioning the discharge lamp 1 is secured in place in an opening of the reflector body 2 and it includes contact elements 20 for connecting the discharge lamp 1 to an operating circuit. A light-shielding material 23 is applied to an outer surface portion of the outer jacket 8 for providing proper beam-pattern. Additionally, a window 4 is secured in place at an utmost front end of the reflector body 2. The window 4 prevents outer moisture and dust from penetrating in an inner space of the reflector body 2.

In order to reduce the harmful effect of the extremely high wall load of the discharge vessel 10 on the useful life of the lamp, a cooling gas fill, such as nitrogen, argon or even helium, may be used in the space between the outer jacket 8 and the discharge vessel 10. The most important characteristics of the cooling gas are a proper thermal conductivity, a chemically indifferent nature and a very low diffusion rate through the wall material of the discharge vessel 10. The extra cooling by the outer fill gas may significantly increase arc luminance while exerting only minor effect on lamp efficacy.

It is a specific requirement of a lighting system for generating pre-determined beam-pattern that the light source has small dimensions. A method of reducing the overall dimension of the ceramic metal halide light source is using legs 14 with asymmetric lengths, i.e. making one ceramic leg 14 of the discharge vessel 10 shorter thank the other one. In addition to the significant reduction of the overall length, this embodiment may also increase the repeatability of lamp performance. Such a modification reduces the variability in lamp performance characteristics due to a much more well defined cold spot within the discharge vessel 10 offered by the existence of a discernible colder leg in the lamp.

The ceramic metal halide lamps have longer life and more stable performance compared to the metal halide lamps used in lighting systems generating predetermined beam-pattern so far. By virtue of an even higher efficacy and the better performance, their life can be sacrificed to a certain extent. The required useful life of the lamps in the applications is determined by the useful life requirements set for the whole lighting system, e.g. a discharge automotive headlamp system. The useful life of the whole lighting system can often be shorter than the useful life of a ceramic metal halide lamp designed for general lighting applications. Reducing the dimensions of the discharge vessel is one method of improving the performance of the overall lighting system at the cost of the life of the lamp. The ultimate limit of such dimensional reduction is an embodiment of the lighting system in which a tubular discharge vessel 10 has substantially the same diameter as the legs 14 at its ends. Thus the discharge vessel 10 is a very thin ceramic tube which offers also benefits if the efficiency of the lighting system and the brightness of the light source is considered. This embodiment can be deemed as an extreme case of the discharge vessel 10 shown in FIG. 1.

Figure 2:
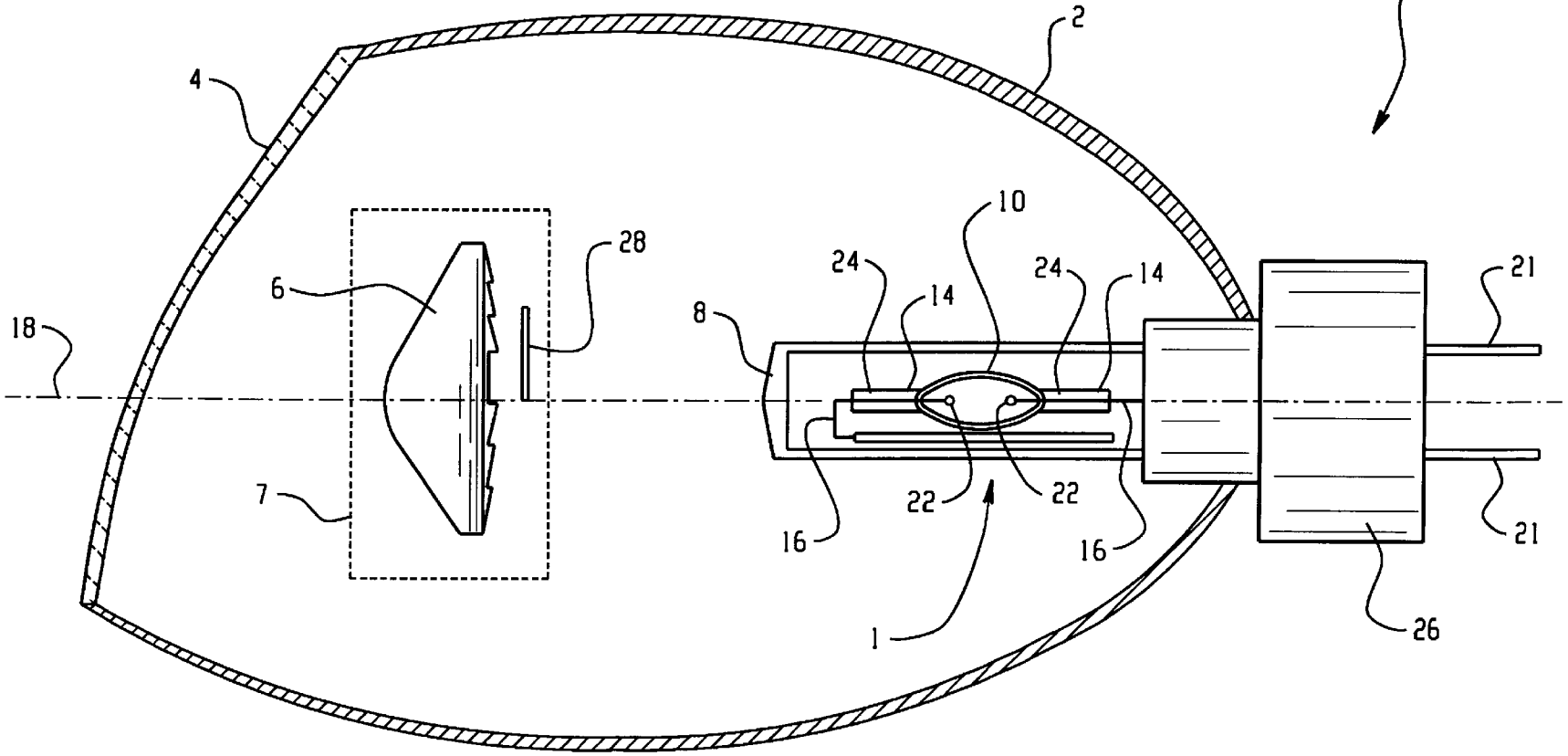
FIG. 2 shows an axial section of a headlamp having a ceramic metal halide lamp with a bulbous discharge vessel and representing a further embodiment of the lighting system.

Referring now to FIG. 2, a reflector for generating pre-determined beam-pattern with ellipsoidal reflector body 2 is illustrated in this figure. The structure of the reflector is basically similar to that shown in FIG. 1. Identical reflector parts are denoted with the same reference numerals, and their description is not repeated herein.

In this embodiment, the sealed discharge vessel 10 made of ceramic light-transmitting material has a bulbous portion. The bulbous portion has two ends, and the legs 14 of the discharge vessel 10 extend from these two ends. The legs 14 of the discharge vessel are covered with a light-shielding material 24 which form means for making the discharge lamp 1 at least approximately a point-like light source. The emitted light escaping from these legs 14 is less uniform and has much lower intensity, so blocking this part of the emitted light reduces the effective dimensions of the light source, i.e. it makes the discharge lamp 1 at least approximately a point-like light source, without loosing significant part of the total radiating flux. In addition, the shielding on these ceramic legs 14 increases their operating temperature. This results in reduced end losses and better performance due to a higher effective temperature of the fill in the sealed discharge vessel 10. The light shielding material 24 may be applied to the ceramic legs 14 in the form of a coating or painting or a metallic foil surrounding the legs 14. The means for making the discharge lamp 1 at least approximately a point-like light source may also be a coloring in the ceramic material of the legs or a portion of the sealed discharge vessel itself with a light-shielding material. It is not indispensable that the legs 14 are covered with the light-shielding material 24 on their whole surface, covering the legs 14 at least partly still remains in the scope of the present invention.

An operating circuit 26 connected to a power supply (not shown) for igniting the discharge lamp 1 and providing for steady-state operation thereof is included in the lamp base 12 which comprises contact terminals 21 for connecting the operating circuit 26 to the power supply. The operating circuit 26 may be built together with the lamp base 12 integrally or disposed in the lamp base 12 itself.

The lens 6 and an optical shield 28 form the optical means 7 for receiving and transmitting the light reflected by the reflector body 2 in the embodiment shown in FIG. 2. The lens 6 may be a Fresnel lens, and the optical shield 28 also participates in producing pre-determined beam-pattern by allowing a cut off to be included.

Full elimination of co-sintered surfaces between the parts of the discharge vessel 10 increases its reliability and durability significantly. A single-piece ceramic metal halide discharge vessel 10 construction also increases the accuracy of the optical alignment process by the improved co-axial feature of the ceramic legs 14 at the ends of the discharge vessel 10.

Figure 3:
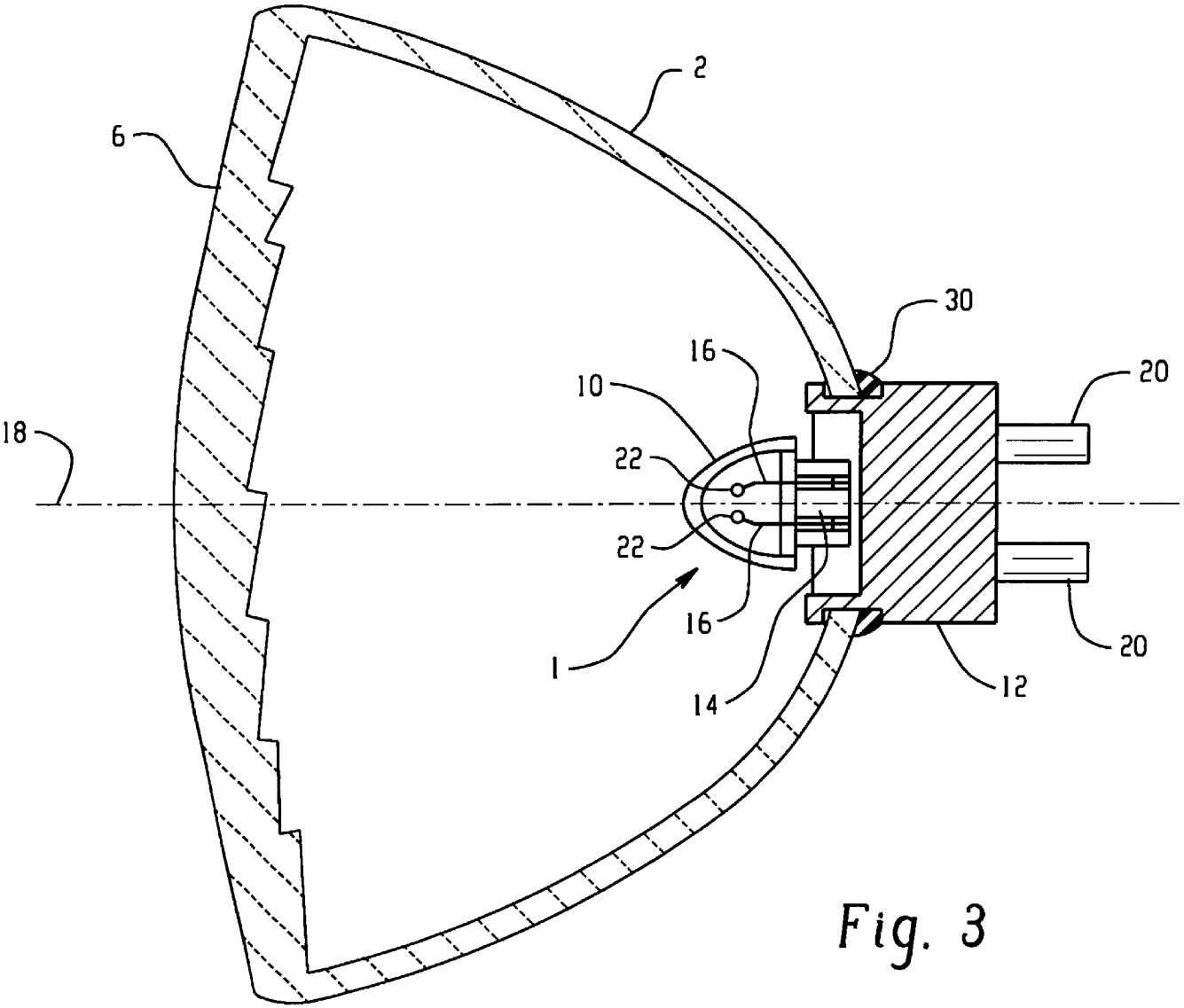
FIG. 3 shows an axial section of a sealed-beam reflector having a ceramic metal halide lamp with a single-ended discharge vessel which is a still further embodiment of the lighting system.

In FIG. 3, a sealed-beam reflector with parabolic reflector body 2 for generating pre-determined beam-pattern is shown. The reflector body 2, the optical means for receiving and transmitting the reflected light, which is a lens 6 in this embodiment, the discharge lamp 1 without an outer jacket and the lamp base 12 are built together integrally to form the sealed beam unit. The sealed discharge vessel 10 has a bulbous portion with a single end. The legs 14 of the discharge vessel extend from this single end. Using a single-ended discharge vessel made of ceramic material leads to the reduction of size, i. e. the discharge lamp 1 approximates a pQint-like source even better. In this case, the arc is not parallel to the optical axis 18 of the lighting system, but this can be compensated either by the design of the lighting system, or by the fact that the ceramic materials are often translucent and the arc is not seen clearly from outside. The translucency can also help in accomplishing a color separation free projection. The lamp base 12 is fixed in the opening of the reflector body 2 using a seal 30 preventing moisture and dust from penetrating into the sealed-beam reflector. The structure of the reflector otherwise is similar to that shown in FIG. 1. Identical reflector parts are denoted with the same reference numerals, and their description is not repeated herein.

Test were conducted in order to investigate whether a discharge lamp 1 with a discharge vessel 10 made of ceramic light-transmitting material meets the requirements of a lighting system for generating pre-determined beam-pattern. A ceramic metal halide lamp of rated power 20W was applied to an automotive reflector. The tubular discharge vessel of the ceramic metal halide lamp was 6.7 millimeter long, and the legs of the discharge vessel extended 11.9 millimeters from its ends. The automotive reflector mounted with this discharge lamp 1 provided a pre-determined beam-pattern including a 15° cut off required by European standards.

The present invention specifically includes the use of the lighting system for headlights of a vehicle, such as an automobile, an aircraft, a locomotive, a water craft and other land traversing vehicles as well as for air traffic taxi lights.

What is claimed is:

1. A lighting system for generating a pre-determined beam-pattern, said system comprising:

a reflector body for reflecting light forwardly thereof said reflector body having an open end;

a cover extending across said open end;

optical means positioned within said reflector body for generating the pre-determined beam-pattern from said forwardly reflected light;

a discharge lamp positioned between the reflector body and said optical means, said discharge lamp comprising:

a sealed discharge vessel made of ceramic light-transmitting material and containing an ionizable fill and having means for making the discharge lamp at least approximately a point-like light source, and a pair of spaced-apart electrodes within the discharge vessel between which an electric discharge is developed when the lamp is operated;

an operating circuit for igniting the discharge lamp and providing for steady-state operation thereof; and, a lamp base for supporting and positioning the discharge lamp and including contact terminals for connecting the operating circuit to a power supply.

2. The lighting system of claim 1, wherein the sealed discharge vessel includes at least one leg and said means for making the discharge lamp at least approximately a point-like light source includes a light-shielding material in the form of a coating or painting or a metallic foil surrounding at least a portion of said at least one leg.

3. The lighting system of claim 1, wherein the sealed discharge vessel includes at least one leg and said means for making the discharge lamp at least approximately a point-like light source includes a light-shielding material surrounding at least a portion of said at least one leg.

4. The lighting system of claim 1, in which an outer jacket made of vitreous material surrounds the discharge vessel.

5. The lighting system of claim 1, in which the sealed discharge vessel has a bulbous portion.

6. The lighting system of claim 5, in which the discharge vessel includes two legs and the bulbous portion has two ends, and the legs of the discharge vessel extend from said ends.

7. The lighting system of claim 5, in which the discharge vessel includes two legs and the bulbous portion has a single end and the legs of the discharge vessel extend from said single end.

8. The lighting system of claim 1, in which the sealed discharge vessel includes at least one leg and said vessel and the leg have a substantially tubular shape.

9. The lighting system of claim 8, in which the sealed discharge vessel and the leg thereof have substantially identical diameter.

10. The lighting system of claim 1, in which the sealed discharge vessel has a first length dimension and includes two legs of different lengths that together with the first length of said discharge vessel define a second length dimension, and one leg of the two legs is shorter than the first length dimension of the discharge vessel.

11. The lighting system of claim 1, in which the sealed discharge vessel is made of a single piece ceramic material without co-sintered surfaces.

12. The lighting system of claim 1, in which the reflector body, the cover, said optical means for generating the pre-determined beam-pattern from the reflected light, the discharge lamp and the lamp base are built together integrally to form a sealed beam unit.

13. The lighting system of claim 1, in which the operating circuit is built together with the lamp base integrally.

14. The lighting system of claim 1, in which the operating circuit is disposed in the lamp base.

15. The lighting system of claim 1, wherein said optical means for generating a pre-determined beam-pattern is integral with said cover.

16. A lighting system for generating a pre-determined beam-pattern of directed light, said lighting system comprising:

a light source having a sealed discharge vessel and a pair of spaced-apart electrodes, said sealed discharge vessel having a vessel wall defining a vessel cavity that contains an ionizable fill, said discharge vessel including shielding material disposed along said discharge vessel for approximating a point-like light source, and said pair of spaced-apart electrodes extend through said vessel wall into said vessel cavity;

a reflector body disposed about said light source and having a curvilinear inside wall with first and second opposing end openings, said inside wall having a reflective surface and configured to reflect light from said light source toward said first end opening;

a lens for refracting light into the pre-determined beam-pattern is positioned within said reflective body between said light source and said first opening;

a cover extending across said first opening;

a lamp base positioned adjacent said second opening and supporting said light source within said reflective body, said lamp base including contact terminals for electrical communication with a power supply; and, an operating circuit for igniting said light source, said circuit in electrical communication between said contact terminals and said spaced-apart electrodes.

17. The lighting system of claim 16 further comprising a blocking member positioned between said light source and said lens for further generating the pre-determined beam-pattern.

18. The lighting system of claim 16, further comprising an outer jacket disposed about said light source and a cooling gas fill within said outer jacket.

19. The lighting system of claim 16, wherein said lens is integral with said cover.

20. The lighting system of claim 16, wherein said lens is a fresnel-type lens.

* * * * *